US009404275B2

(12) United States Patent
Lamb

(10) Patent No.: US 9,404,275 B2
(45) Date of Patent: Aug. 2, 2016

(54) REINFORCING BAR WIRE TYING APPARATUS

(75) Inventor: Frederick W. Lamb, McDonald, PA (US)

(73) Assignee: PneuTools, Incorporated, Memphis, TN (US)

( * ) Notice: Subject to any disclaimer, the term of this patent is extended or adjusted under 35 U.S.C. 154(b) by 646 days.

(21) Appl. No.: 12/956,567

(22) Filed: Nov. 30, 2010

(65) Prior Publication Data

US 2012/0132312 A1 May 31, 2012

(51) Int. Cl.
*E04G 21/12* (2006.01)
*B65B 13/28* (2006.01)

(52) U.S. Cl.
CPC ..... *E04G 21/123* (2013.01); *B65B 13/28* (2013.01); *B65B 13/285* (2013.01); *E04G 21/122* (2013.01)

(58) Field of Classification Search
CPC ... E04G 21/123; E04G 21/122; B65B 13/285; B65B 13/28
USPC ..... 140/119, 93.6, 57
See application file for complete search history.

(56) References Cited

U.S. PATENT DOCUMENTS 3,391,715 A * 7/1968 Thompson ..... 140/93.6
3,587,668 A * 6/1971 Ward ..... 140/93.6
4,094,342 A 6/1978 Nishikawa et al.
4,362,192 A 12/1982 Furlong et al.
5,279,336 A 1/1994 Kusakari et al.
5,323,816 A * 6/1994 Hoyaukin ..... 140/57
5,515,887 A 5/1996 Hanagasaki et al.
5,558,134 A 9/1996 Miyazaki
5,678,613 A 10/1997 Murayama et al.
5,694,983 A 12/1997 Kusakari et al.
5,831,404 A 11/1998 Ishii
D403,937 S 1/1999 Hattori
5,871,036 A 2/1999 Murayama et al.
5,874,816 A 2/1999 Ishii
D409,476 S 5/1999 Kusakari
5,956,989 A 9/1999 Kusakari
6,401,766 B1 6/2002 Ishikawa et al.
D481,602 S 11/2003 Hattori (Continued)

OTHER PUBLICATIONS

Mijy-Land Industrial Co. Ltd, Mijy-Land Industrial Co., vr.ttnet.net/mijyland/spec_bbp.html (date unknown) Lujhou City, Taipei, Hsien, Taiwan (one page from manufacturers web site with specifications for various pneumatic air screwdrivers with torque-release clutches).

*Primary Examiner* — Alexander P Taousakis
*Assistant Examiner* — Mohammad I Yusuf
(74) *Attorney, Agent, or Firm* — Walker, McKenzie & Walker, P.C.

(57) ABSTRACT

A binding wire twisting apparatus for tying reinforcing bars. A motor rotates a shaft upon which a member reciprocates from a rearward to a forward position. The apparatus includes opposed fingers with opposed channels for fed binding wire. When in the rearward position, the member drives a wire feeding unit that feeds binding wire though the fingers and around the reinforcing bars. When the leading end of the fed wire impacts an actuator of a four-way valve, a pneumatic cylinder reciprocates the member from the first to the second position, and a cutter cuts the wire. Once in the second position, gripping surfaces entrap and hold the ends of the wire, and the rotating member, while holding the ends of the wire between first and second grip pieces, twists and ties the wire around the reinforcing bars, and a torque-release clutch decouples the motor from the shaft.

5 Claims, 9 Drawing Sheets

(56) References Cited

U.S. PATENT DOCUMENTS

| | | | | |
|---|---|---|---|---|
| 6,714,399 | B2 | 3/2004 | Ehara | |
| D489,399 | S | 5/2004 | Kusakari | |
| 7,051,650 | B2 | 5/2006 | Kusakari et al. | |
| D527,041 | S | 8/2006 | Nagaoka et al. | |
| 7,140,400 | B2 | 11/2006 | Yokochi | |
| 7,143,792 | B2 | 12/2006 | Ishikawa et al. | |
| 7,255,135 | B2 | 8/2007 | Ishikawa et al. | |
| 7,275,567 | B2 | 10/2007 | Ishii et al. | |
| 7,353,846 | B2 | 4/2008 | Kusakari et al. | |
| 7,398,800 | B2 | 7/2008 | Kusakari et al. | |
| 7,448,417 | B2 | 11/2008 | Itagaki | |
| D619,437 | S | 7/2010 | Hattori | |
| 8,047,239 | B2 * | 11/2011 | Hoyaukin | 140/119 |
| 8,127,803 | B2 * | 3/2012 | Kusakari | 140/123.6 |
| 8,752,593 | B2 * | 6/2014 | Kusakari et al. | 140/123.6 |

* cited by examiner

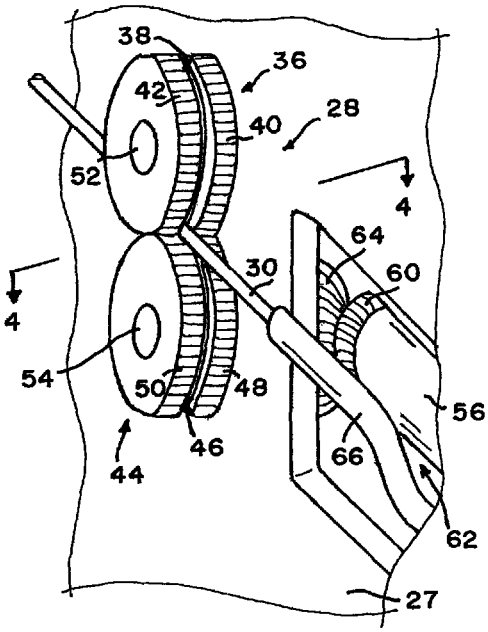
FIG. 3
FIG. 4
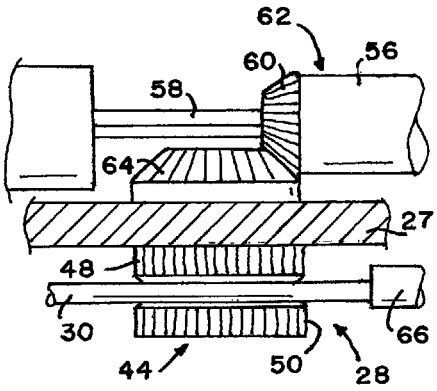
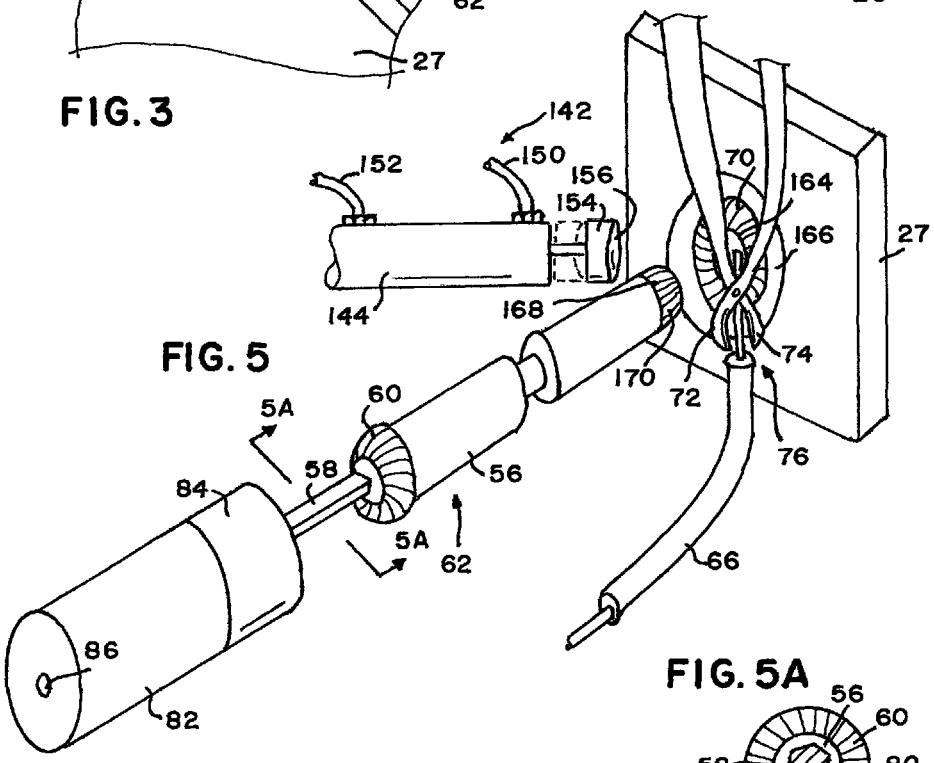
FIG. 5
FIG. 5A
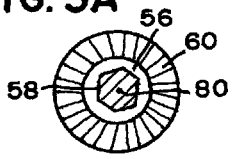

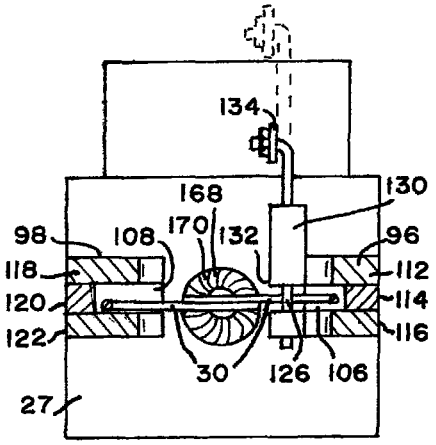
FIG. 9
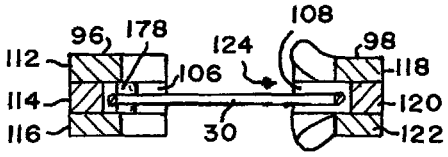
FIG. 10
FIG. 11
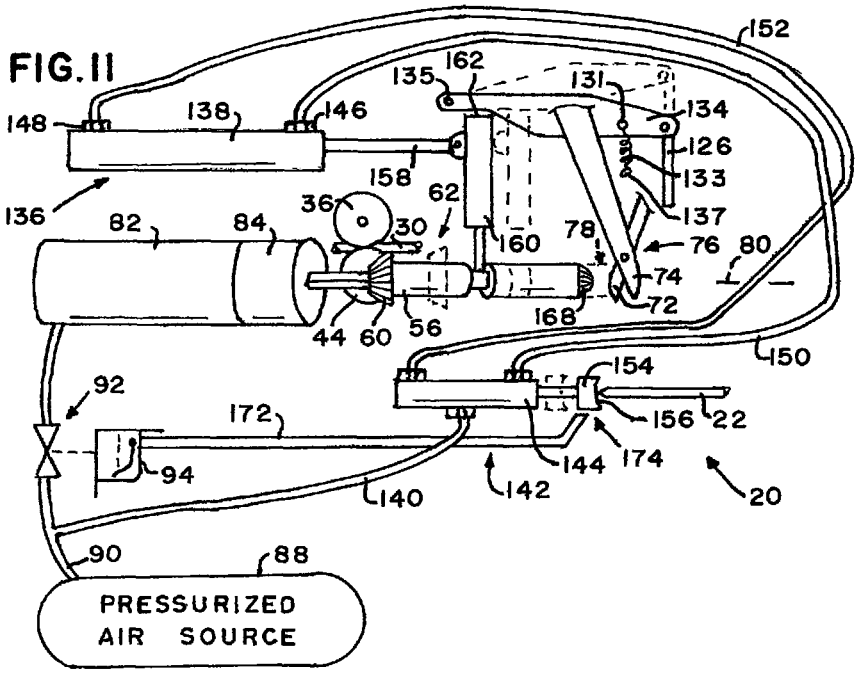

REINFORCING BAR WIRE TYING APPARATUS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO COMPACT DISC(S)

Not applicable.

BACKGROUND OF THE INVENTION

1. Field of the Invention

The present invention relates, in general, to tools used in construction of reinforced concrete structures, and in particular, to tools for tying together the reinforcing bars (hereinafter, "re-bars") used within reinforced concrete structures.

2. Information Disclosure Statement

When constructing structures that employ reinforced concrete, the steel re-bars within the reinforced concrete are typically tied together with binding wires, prior to pouring concrete into the forms, so as to stabilize the position of the re-bars within the reinforced concrete structure during the pouring process, and the ends of the binding wires, after being looped around the re-bars, are typically twisted together so as to retain the binding wire around the re-bars. Because the process of tying re-bars with binding wire is very labor intensive, it is known to use powered mechanical apparatus to do this binding of the re-bars with binding wire, often with the binding wire being continuously fed from a spool and then cut to a desired length, usually prior to twisting the ends of the binding wire. Prior art re-bar tying apparatus are complex with a large number of moving parts that can reduce the reliability of such re-bar tying apparatus.

It is therefore desirable to have a powered re-bar wire tying apparatus that quickly and efficiently encircles two or more re-bars with a length of binding wire and then twists the ends of the binding wire to bind the re-bars together. It is further desirable to provide a powered re-bar wire tying apparatus that is simpler than heretofore provided by the prior art.

Nishikawa et al., U.S. Pat. No. 4,094,342 (issued Jun. 13, 1978), discloses a pneumatic binder for lacing together a bundle of electrical wires.

Furlong et al., U.S. Pat. No. 4,362,192 (issued Dec. 7, 1982), discloses a powered tool having a movable pair of jaws in which the binding wire is fed within loop-forming grooves in the jaws.

Kusakari, U.S. Pat. No. 5,279,336 (issued Jan. 18, 1994), discloses a wire binder for binding reinforcing bars in which binding wire is supplied from a spool and a wire-twisting motor twists the ends of the binding wire.

Hanagasaki et al., U.S. Pat. No. 5,515,887 (issued May 14, 1996), discloses a wire reel used in a reinforcing bar binding machine.

Miyazaki, U.S. Pat. No. 5,558,134 (issued Sep. 24, 1996), discloses a binding wire guide mechanism used in a reinforcing bar tying apparatus, which guides binding wire into a wire loop around reinforcing bars.

Murayama et al., U.S. Pat. No. 5,678,613 (issued Oct. 21, 1997), discloses a reinforcing bar binding machine with movable jaws that guide fed wire into a loop shape and then twists the ends of the wire and cuts the wire.

Kusakari, U.S. Pat. No. 5,694,983 (issued Dec. 9, 1997), discloses a reinforcing bar tying apparatus that has movable jaws. Wire is fed from the apparatus, curled around the reinforcing bar, twisted, and cut.

Ishii, U.S. Pat. No. 5,831,404 (issued Nov. 3, 1998), discloses a method of preventing wire from being twisted off in a reinforcing bar tying apparatus, in which a motor torque is electrically monitored and the twisting operation is ended when the motor torque reaches a peak.

Murayama et al., U.S. Pat. No. 5,871,036 (issued Feb. 16, 1999), discloses a reinforcement bar binding apparatus having movable jaws in which wire is fed to a guide that loops the wire around reinforcing bars and twists the wire.

Ishii, U.S. Pat. No. 5,874,816 (issued Feb. 23, 1999), discloses a reinforcing bar tying apparatus that feeds wire, loops the wire around reinforcing bars, twists the wire, and cuts the wire, and which stops the twisting when the torque does not increase after a predetermined time from starting the twisting operation.

Kusakari, U.S. Pat. No. 5,956,989 (issued Sep. 28, 1999), discloses a wire twisting device for use in a reinforcement bar binding machine.

Ishikawa et al., U.S. Pat. No. 6,401,766 (issued Jun. 11, 2002), discloses a reinforcing bar tying apparatus that adjusts to accommodate the diameter of the loop of the binding wire, and has a movable jaw.

Ehara, U.S. Pat. No. 6,714,399 (issued Mar. 30, 2004), discloses a method of controlling a solenoid actuator by monitoring the drive current of the solenoid drive.

Kusakari et al., U.S. Pat. No. 7,051,650 (issued May 30, 2006), discloses a stranding wire twisting device for a reinforcement bar binding machine, in which a twisting shaft with hooks engages a wire loop of binding wire.

Yokochi et al., U.S. Pat. No. 7,140,400 (issued Nov. 28, 2006), discloses a reinforcing bar binding machine with a binding wire feeding mechanism having a drive sheave and a driven sheave with V-grooves therearound.

Ishikawa et al., U.S. Pat. No. 7,143,792 (issued Dec. 5, 2006), discloses a reinforcing bar binding machine having spaced jaws and a twisting mechanism that grabs the ends of the binding wire and then moves rearward with the grabbed wire.

Ishikawa et al., U.S. Pat. No. 7,255,135 (issued Aug. 14, 2007), discloses a reinforcing bar tying machine with movable jaws and rearward-moving clamp plates that grab the ends of the binding wire.

Ishii et al., U.S. Pat. No. 7,275,567 (issued Oct. 2, 2007), discloses a reinforcing bar binding machine that feds binding wire and then clamps the end of the binding wire and pulls back while twisting the wire.

Kusakari et al., U.S. Pat. No. 7,353,846 (issued Apr. 8, 2008), discloses a reinforcing bar binding machine with a cooling fan for cooling the twisting motor.

Kusakari et al., U.S. Pat. No. 7,398,800 (issued Jul. 15, 2008), discloses a reinforcing bar binding machine that has a warm-up cycle for use in a cold environment.

Itagaki, U.S. Pat. No. 7,448,417 (issued Nov. 11, 2008), discloses a reinforcing bar binding machine that allows setting of the number of turns by which the binding wire is twisted.

Hattori, U.S. Pat. No. Des. 403,937 (issued Jan. 12, 1999), discloses a reinforcing bar binding machine with a battery pack for powering an electric motor of the binding machine.

Kusakari, U.S. Pat. No. Des. 409,476 (issued May 11, 1999), discloses a wire bobbin or spool that can be used by a reinforcing bar binding machine.

Hattori, U.S. Pat. No. Des. 481,602 (issued Nov. 4, 2003), discloses a reinforcing bar binding machine having a wire spool and a battery pack for powering an electric motor of the binding machine.

Kusakari, U.S. Pat. No. Des. 489,399 (issued May 4, 2004), discloses a wire bobbin or spool that can be used by a reinforcing bar binding machine.

Nagaoka et al., U.S. Pat. No. Des. 527,041 (issued Aug. 22, 2006), discloses a wire bobbin or spool that can be used by a reinforcing bar binding machine.

Hattori, U.S. Pat. No. Des. 619,437 (issued Jul. 13, 2010), discloses a reinforcing bar binding machine having a wire spool and a battery pack for powering an electric motor of the binding machine.

None of these references, either singly or in combination, discloses or suggests the present invention.

BRIEF SUMMARY OF THE INVENTION

The present invention is a binding wire twisting apparatus for tying reinforcing bars. A motor, either pneumatic or electric, rotates a shaft upon which a member reciprocates from a first (rearward) position to a second (forward) position, with the member being coupled for mutual rotation with the shaft. The apparatus includes first and second opposed fingers with distal tips that are fixedly spaced apart by a gap, and the first and second fingers respectively have first and second opposed channels adapted for slidingly receiving fed binding wire. A first grip piece having a first opening therethrough with a first gripping surface therearound is mounted for rotation coaxial with the axis of the shaft, and a second grip piece with a second gripping surface is at the forward end of the member. When in the rearward position, the member drives a wire feeding unit that selectively feeds binding wire through the first opening, into the first channel of the first finger, then across the gap, then into the second channel of the second finger and back through the first opening of the first grip piece. When the leading end of the fed wire impacts a target on an actuator of a four-way valve, a pneumatic cylinder is caused to reciprocate the member from the first position to the second position. As the member moves into the second position, a cutter cuts the wire. Once in the second position, the second gripping surface of the second grip piece entraps and holds the ends of the wire to the first gripping surface of the first grip piece, and the rotating member, while holding the ends of the wire between the first and second grip pieces, twists and ties the wire around the reinforcing bars. As the wire becomes tied, the wire is pulled from the channels of the fingers. A torque-release clutch decouples the motor from the shaft when the torque on the tied wire passes an adjusted threshold.

It is an object of the present invention to provide a binding wire twisting apparatus for tying reinforcing bars. It is a further object of the present invention to provide a simpler and thus more reliable binding wire twisting apparatus than heretofore known in the prior art.

BRIEF DESCRIPTION OF THE SEVERAL VIEWS OF THE DRAWING

FIG. 3 is a perspective view of the wire feeding unit of the present invention.

FIG. 4 is a top sectional view of the wire feeding unit of the present invention, taken substantially along the line 4-4 shown in FIG. 3.

FIG. 5 is a perspective view of certain parts of the present invention with other parts removed for clarity.

FIG. 5A is a transverse sectional view showing the mounting of the member on the shaft of the present invention, and showing the first gear of the member, taken substantially along the line 5A-5A shown in FIG. 5.

FIG. 9 is a front sectional view of a portion of the present invention, taken substantially along the line 9-9 shown in FIG. 7.

FIG. 10 is a front sectional view of the present invention, taken substantially along the line 10-10 shown in FIG. 7.

FIG. 11 is a schematic diagram of the first embodiment of the present invention, showing the operation of various parts.

DETAILED DESCRIPTION OF THE INVENTION

Figure 1:
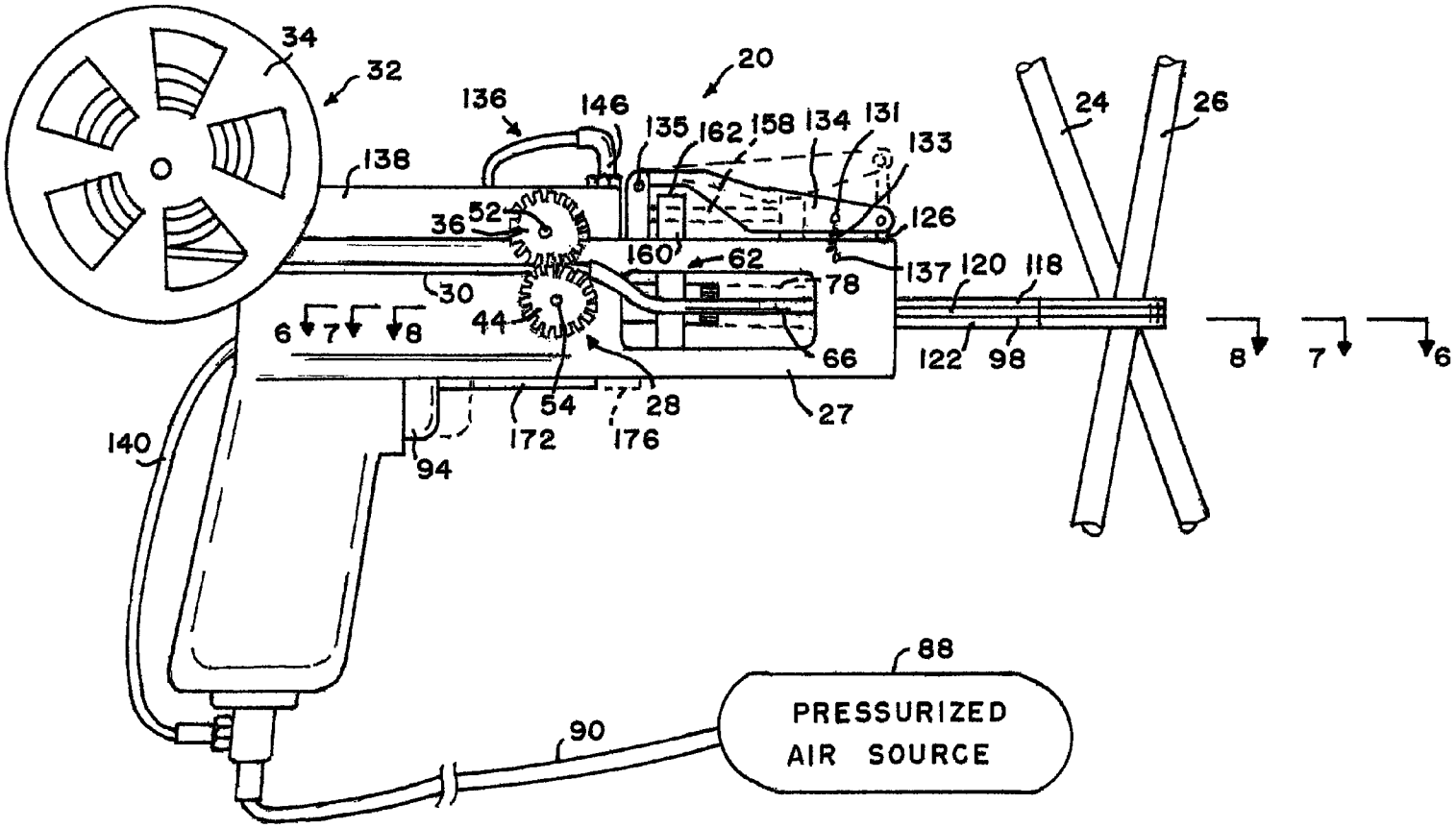
FIG. 1 is a right side view of a first embodiment of the present invention, showing the tying together of two reinforcing bars.
Figure 2:
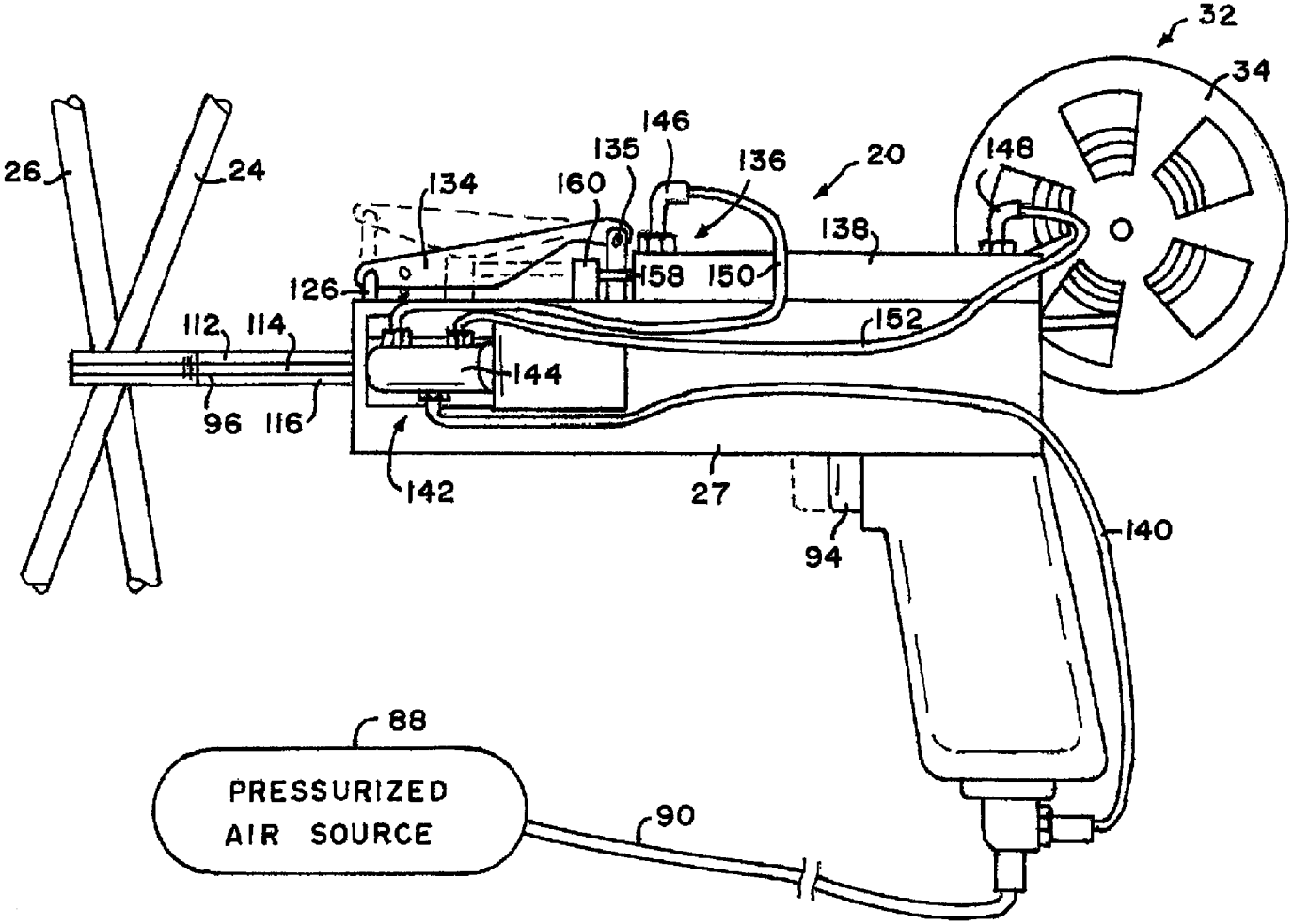
FIG. 2 is a left side view of the first embodiment of the present invention, showing the tying together of two reinforcing bars.

Referring to FIGS. 1-11, the first embodiment 20 of the binding wire twisting apparatus of the present invention is shown tying a portion 22 of binding wire 30 to well-known reinforcing bars ("re-bars") 24 and 26.

Apparatus 20 has a body 27 and includes a wire feeding unit 28 for selectively feeding binding wire 30 from a supply 32 of binding wire, and the supply 32 of binding wire may be a well-known spool or bobbin 34 on which the binding wire is wound. Depending on the particular application and sizes of re-bar being tied, differing gauges of binding wire may be chosen, in a manner well-known to those skilled in the art, for use with the present invention.

As best seen in FIGS. 1, 3, and 4, wire feeding unit 28 preferably includes a first sheave 36 having a first circumferential groove 38 therearound between first and second circumferential sets 40, 42 of gear teeth, and a second sheave 44 having a second circumferential groove 46 therearound between third and fourth circumferential sets 48, 50 of gear teeth, with the gear teeth of first sheave 36 being engaged with the gear teeth of second sheave 44 so as to operably couple first and second sheaves 36, 44 for mutual opposite-direction rotation as first sheave 36 turns upon a first sheave axle 52 and second sheave 44 turns upon a second sheave axle 54. Grooves 38 and 46 are adapted for frictionally receiving binding wire 30 therebetween so as to feed the binding wire 30 as first and second sheaves 36, 44 mutually rotate in opposite directions. An example of such sheaves and their feeding of binding wire is shown in Yokochi et al., U.S. Pat. No. 7,140,400 (issued Nov. 28, 2006), fully incorporated by reference herein.

As seen best in FIGS. 3 and 4, one of first and second sheaves 36, 44 is selectively operably coupled, in a manner hereinafter described in detail, to a member 56 that is coupled for mutual rotation with a rotating shaft 58 of apparatus 20 in a manner hereinafter described in detail. Member 56 preferably has a first gear 60 that, when member 56 is in a first position 62 shown in FIG. 4, engages with a second gear 64 of one of first and second sheaves 36, 44, preferably such as second gear 64 fixedly mounted with second sheave 44 upon second sheave axle 54, operably couples member 56 to second sheave 44 so that rotation of member 56 with shaft 58 drives second sheave 44 to rotate, and second sheave 44, by the engagement of third and fourth circumferential sets 48, 50 of gear teeth with first and second circumferential sets of gear teeth 40, 42, causes first sheave 36 to be driven to rotate as well, thereby feeding binding wire 30 in a manner that is now understood.

Member 56 is coupled for mutual rotation with rotating shaft 58 as by shaft 58 being splined, keyed, or preferably having a hexagonal shape in transverse cross section as shown in FIG. 5A, with member 56 having an axial bore therethrough adapted for sliding mating engagement with shaft 58 so as to permit member 56 to slidingly reciprocate upon shaft 58 and with respect to shaft 58.

Figure 7:
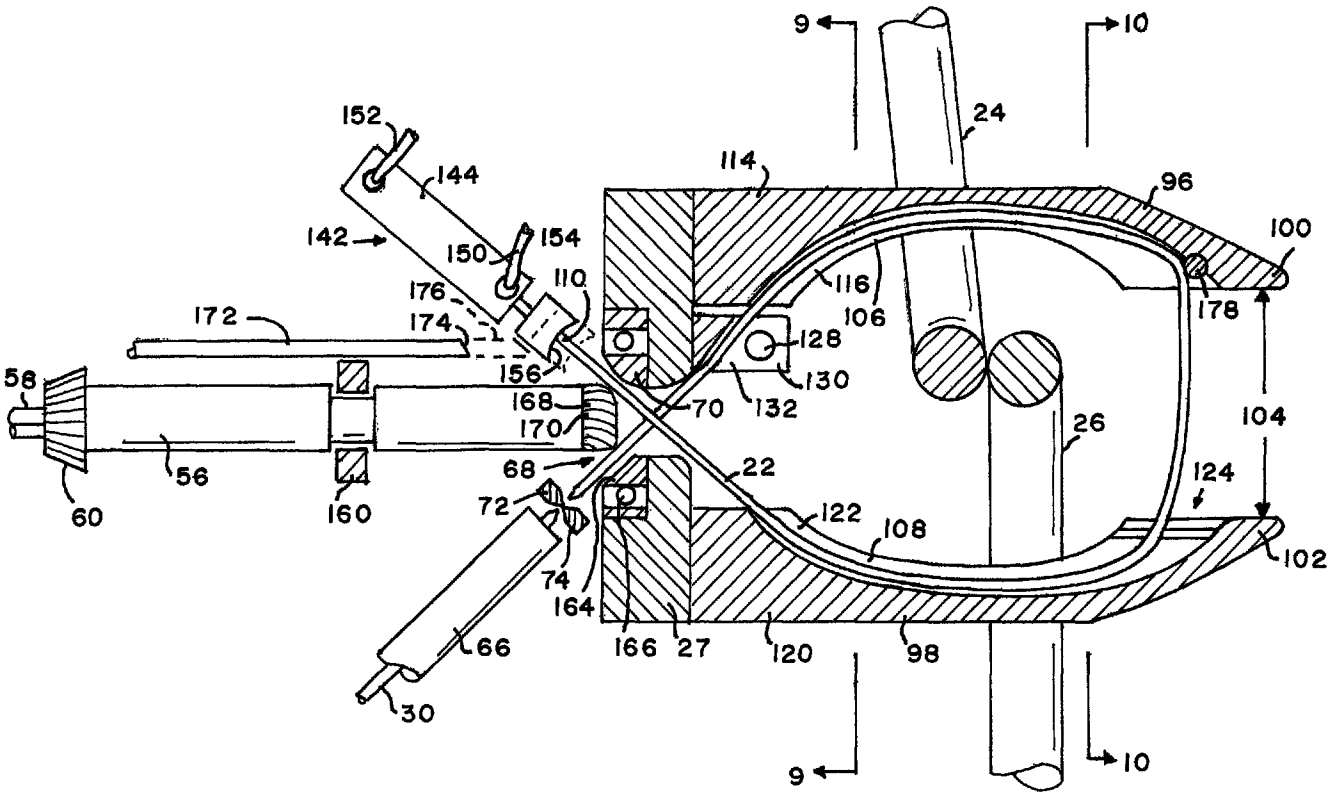
FIG. 7 is a top sectional view of a portion of the present invention with some parts removed for clarity, taken substantially along the line 7-7 shown in FIG. 1, similar to FIG. 6 but just after the leading end of the binding wire impacts the target of the control means.
Figure 8:
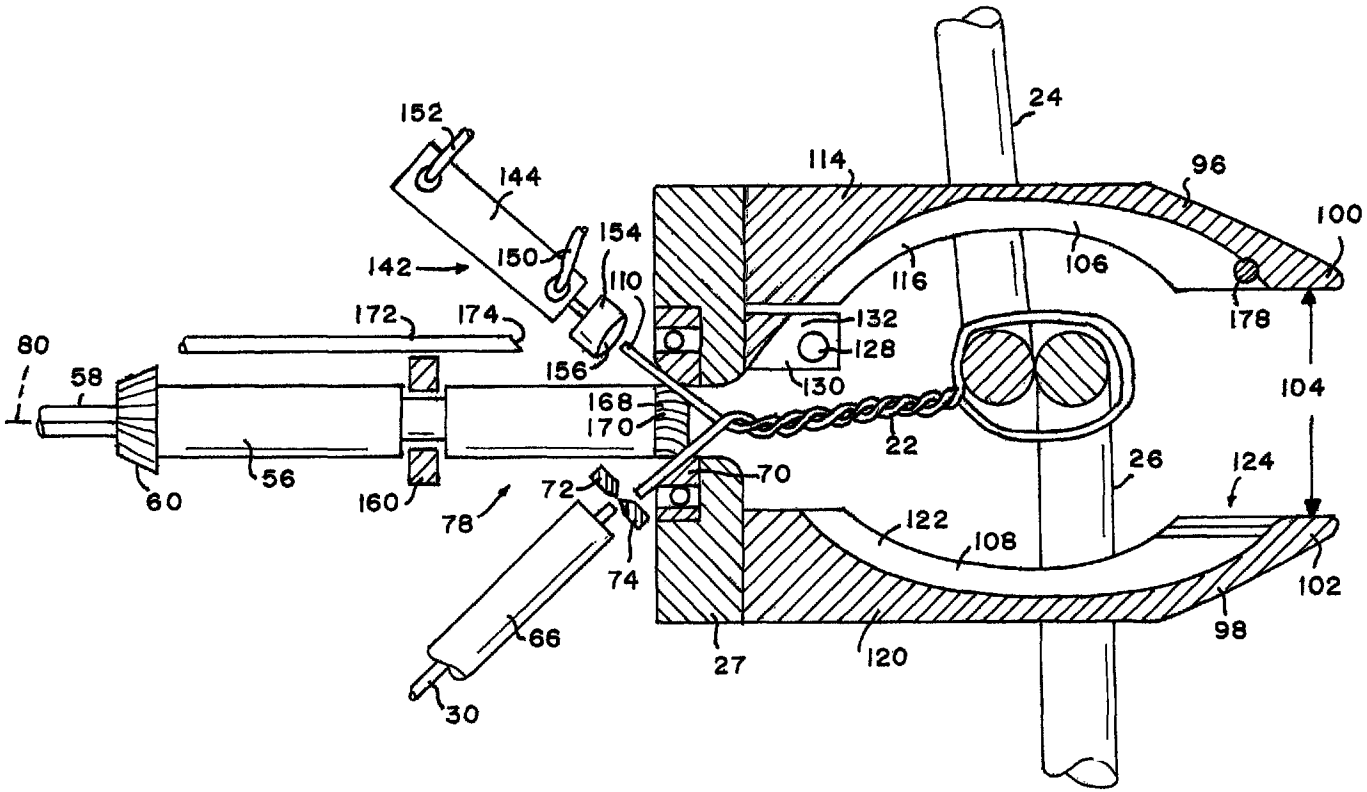
FIG. 8 is a top sectional view of a portion of the present invention with some parts removed for clarity, taken substantially along the line 8-8 shown in FIG. 1, similar to FIGS. 6 and 7 but showing the twisting of the binding wire.

As wire 30 emerges from the wire feeding unit 28, it enters a guide tube 66 that directs wire 30 toward and through a first opening 68 of a first grip piece 70, hereinafter described in detail. As wire 30 emerges from guide tube 66, it passes through the scissor-like jaws 72, 74 of a cutter 76 that is engaged to cut wire 30 as member 56 reciprocates upon shaft 58, and with respect to shaft 58, from first position 62 into a second position 78 as shown in FIG. 8, with FIG. 7 showing member 56 approaching and almost but not yet fully into second position 78.

Shaft 58 has a longitudinal axis of rotation 80 and is rotated about that axis by a motor 82. In the first preferred embodiment 20, motor 82 is a pneumatic motor having a well-known adjustable torque-release clutch 84 interposed between the output shaft of motor 82 and shaft 58, and torque-release clutch 84 decouples the shaft 86 of motor 82 from shaft 58 such that clutch 84 becomes disengaged when the rotation of shaft 58 by motor 82 is opposed as the torque resistance encountered upon twisting the binding wire increases past a predetermined desired torque threshold, and that torque resistance depends on the size of binding wire being used and how tight of a twisted tie is desired. If the torque threshold is set too low by the user of the present invention, the tie will not be twisted tightly enough. If the torque threshold is set too high, the tie will be twisted too tightly and the binding wire will break rather than hold the re-bar together.

A suitable pneumatic motor 82 with torque-release clutch 84 for use with the present invention is the well-known type used in the model R55BBP pneumatic air screwdriver with torque release clutch sold by Mijy-Land Industrial Co., Ltd., 21, Lane 323, Fuh Hsing Rd. Lujhou City, Taipei, Hsien, Taiwan 247, which has a nominal free-running speed of 1000 RPM and an adjustable torque-release range of 12 to 75 Kgf-cm (about 1.2 Newton-meters to 7.4 Newton-meters).

Pneumatic motor 82 is powered from a well-known source 88 of pressurized air, such as a well-known compressor, with a pressurized air hose 90 connecting motor 82 to pressurized air source 88. Interposed between air source 88 and motor 82 is a well-known valve 92 that is operated by a spring-loaded trigger 94 to selectively apply pressurized air to motor 82 such that, when trigger 94 is depressed (shown in solid outline in FIGS. 1 and 2), valve 92 opens and allows pressurized air from source 88 to cause motor 82 to turn its shaft 86 and operate apparatus 20. When trigger 94 is released (shown in dotted outline in FIGS. 1 and 2), valve 92 closes, thereby removing the pressurized air from motor 82 and ceasing the turning of shaft 86.

Figure 6:
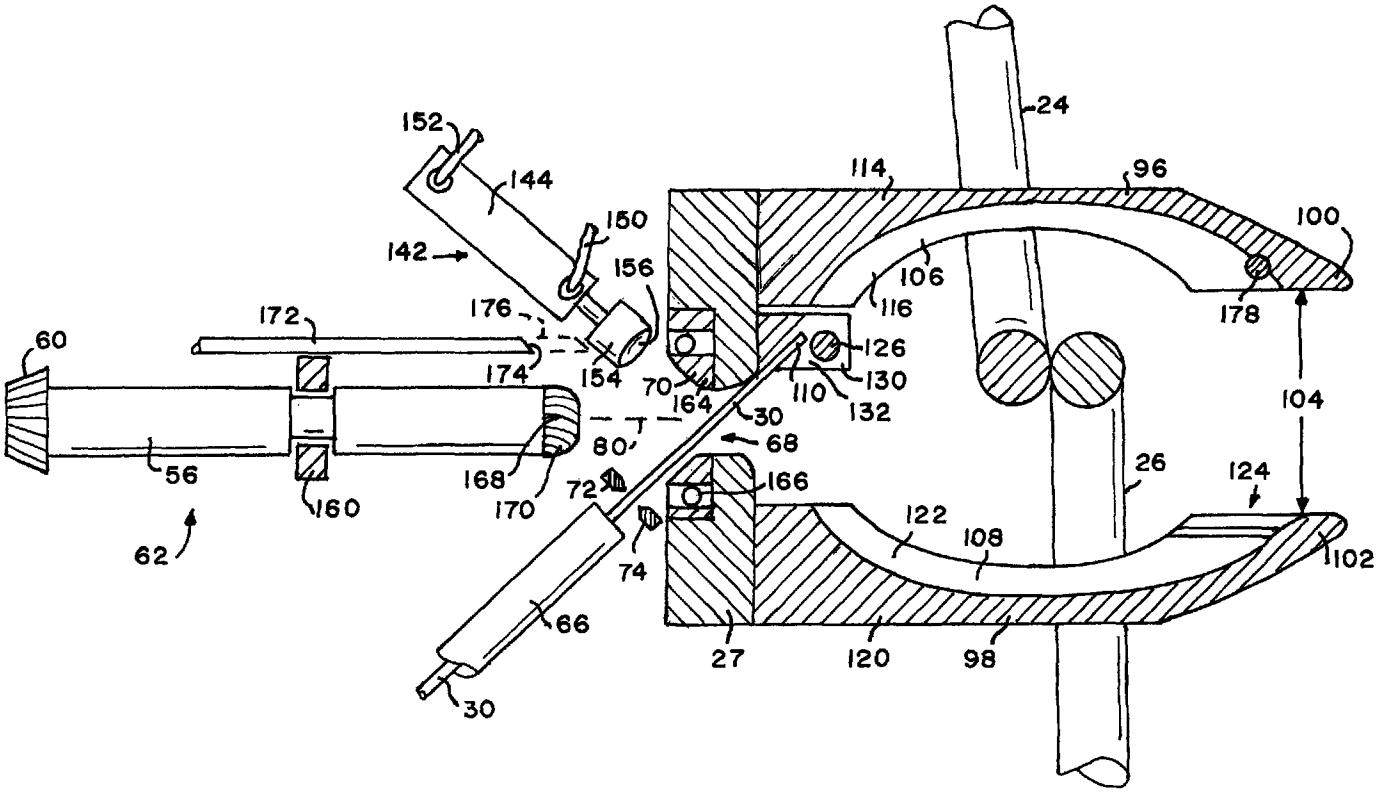
FIG. 6 is a top sectional view of a portion of the present invention with some parts removed for clarity, taken substantially along the line 6-6 shown in FIG. 1, as the leading end of the binding wire is fed through the first opening of the first grip piece.

As best seen in FIGS. 1, 2, 6, 7, and 8, apparatus 20 includes first and second opposed fingers 96, 98 respectively having first and second distal tips 100, 102. Distal tips 100 and 102 are fixedly spaced apart from each other by a gap 104, with gap 104 being large enough to permit passage of re-bars 24, 26 therethrough so as to allow fingers 96, 98 to encircle re-bars 24, 26 for tying. In contrast to prior art re-bar tying devices, which had complicated mechanisms for opening and closing of fingers around re-bars, the present invention's simpler structure produces an improved re-bar tying tool. First and second opposed fingers 96, 98 have first and second opposed channels 106, 108 therein adapted for slidingly receiving binding wire 30 therewithin as a leading end 110 of binding wire is fed, by wire feeding unit 28 and out of guide tube 66, through first opening 68 of first grip piece 70, into the first channel 106 of first finger 96, then across gap 104, then into second channel 108 of second finger 98, and then back through first opening 68 of first grip piece 70, as best seen in FIGS. 6 and 7. First opposed finger 96 is preferably a three-layer sandwich construction of metal pieces 112, 114, 116 forming channel 106, and, likewise, second opposed finger 98 is preferably a three-layer sandwich construction of metal pieces 118, 120, 122 forming channel 108, with the sandwiched pieces of each finger preferably being riveted or screwed together in a manner well-known to those skilled in the art. The distal entrance 124 to second channel 108 is preferably enlarged, as by respective upward and downward flaring of pieces 118 and 122 (best seen in FIG. 10) so as to form an enlarged mouth to capture the leading end 110 of wire 30 as it passes from first channel 106 across gap 104 into second channel 108.

To selectively and entrapingly retain wire 30 within channel 106, apparatus 20 preferably has a vertically-reciprocating retaining pin 126, seen best in FIGS. 6 and 9, that reciprocates up and down within a bore 128 in block 130 affixed to the body of apparatus 20, with block 130 having a forward-facing slot 132, with slot 132 being in alignment with channel 106. While member 56 is in its first (rearward) position 62, pin 126 spans slot 132 so as to guide and retain wire 30 into and within channel 106. As member 56 moves into its second (forward) position 78, as hereinafter explained, arm 134, pivotally mounted to the body of apparatus 20 as at pivot 135 and coupled to pin 126, is caused to raise pin 126 so as to no longer entrap wire 30 in slot 132 of block 130 (compare the solid outline position of arm 134 with the dotted outline position of arm 134 in FIGS. 1, 2, and 9), thereby allowing wire 30 to be pulled out of channels 106, 108 as the wire becomes twisted around the re-bar by apparatus 20, in a manner hereinafter described in detail. As best seen in FIGS. 1 and 11, a spring 133 extends from a rivet or bolt 131, attached to arm 134, to a rod 137 mounted transversely within body 27 so as to exert a force that tends to pull arm 134, when raised as shown in dotted outline in FIGS. 1 and 11, back to its unraised position shown in solid outline in FIGS. 1 and 11, in a manner hereinafter described in detail.

Apparatus 20 further includes reciprocating means 136, operably coupled to member 56, for reciprocating member 56 from its first (rearward) position 62 to its second (forward) position 78. Reciprocating means 136 preferably includes a well-known pneumatic cylinder 138, connected to pressurized air source 88 as through an air hose 140. Apparatus 20 further includes control means 142 for selectively causing reciprocating means 136 to reciprocate member 56 from first (rearward) position 62 to second (forward) position 78 and back. Preferably, control means 142 includes a well-known four-way valve 144, interposed between pneumatic cylinder 138 and air source 88, that is connected to the forward and rearward ports 146, 148 of pneumatic cylinder 138 as by air hoses 150 and 152, respectively. The actuator 154 of four-way valve 144 includes a target or cup 156 at the distal end of actuator 154 for being impacted by the leading end 110 of the fed binding wire 30. As the leading end 110 of wire 30 contacts and impacts target 156, it causes actuator 154 of four-way valve to move from an extended position, shown in solid outline in FIGS. 5, 6, and 11 and in dotted outline in FIG. 7, to a refracted position, shown in dotted outline in FIGS. 5 and 11 and in solid outline in FIGS. 7 and 8. When actuator 154 is in its extended position, the forward port 146 of pneumatic cylinder 138 is supplied pressurized air from air source 88 by valve 144 through hose 150, and rearward port 148 is vented, thereby causing the rod 158 of pneumatic cylinder 138 to retract. When actuator 154 is in its retracted position, the rearward port 148 of pneumatic cylinder 138 is supplied pressurized air from air source 88 by valve 144 through hose 152, and forward port 146 is vented, thereby causing the rod 158 of pneumatic cylinder 138 to extend.

The distal end of rod 158 is operably coupled to member 56 as through coupling piece 160 of reciprocating means 136, and coupling piece 160 is mounted for forward and rearward reciprocation within the body of apparatus 20. The upper edge 162 of coupling piece 160, as it reciprocates forward, engages with arm 134 to lift pin 126 and thereby no longer entrap wire 30 within block 130. Furthermore, as coupling piece 160 reciprocates forward and thereby causes member 56 to reciprocate into second position 78, and before member 56 reaches the second position 78, coupling piece 160 actuates cutter 76 to cut the wire 30 as best seen in FIG. 7.

Apparatus 20 further includes a first grip piece 70 having a first opening 68 therethrough, and first opening 68 is coaxial with the axis 80 of rotation of shaft 58. First opening 68 has a first gripping surface 164 therearound that is teethed as shown for gripping the ends of the wire 30 during twisting, and first grip piece 70 is mounted within the body 27 of apparatus 20 for coaxial rotation about axis 80, as by having an included bearing 166 that is pressed into body 27. The forward end of member 56 includes a second grip piece 168 having a second teethed gripping surface 170 adapted for grippingly entrapping the ends of the fed binding wire 30 between second gripping surface 170 and first gripping surface 164 with mutual rotation of the first and second gripping pieces 70, 168 when member 56 is in the second (forward) position 78.

Furthermore, for initializing actuator 154 into its extended position, a mechanical linkage 172 is coupled to trigger 94 so that, when trigger 94 is released, a forward end 174 of linkage 172 engagingly pushes (see dotted outline position 176 in FIG. 6) actuator 154 into its extended position, thereby causing pneumatic cylinder 138 to retract its rod 158, thereby moving member 56 into its first (rearward) position 62.

Now that the parts of apparatus 20 have been described, the use and operation of apparatus 20 can now be explained.

Apparatus 20 is first connected to pressurized air source 88 as by hose 90 and trigger 94 is released, thereby causing motor 82 to stop spinning and causing linkage 172 to ensure that actuator 154 of four-way valve 144 is in its extended position, thereby causing pneumatic cylinder 138 to retract rod 158, thereby causing pin 126 to drop into block 130 and causing member 56 to retract into the first (rearward) position 62. While member 56 is in first position 62, first gear 60 of member 56 engages second gear 64 of second sheave 44. However, because motor 82 is not spinning, wire feeding unit 28 does not feed wire 30 from spool 34. A pair of reinforcing bars 24, 26 are passed through gap 104 so as to be between first and second fingers 96, 98.

When trigger 94 is pressed, pressurized air is then caused to flow to motor 82, causing motor 82 to rotate its shaft 86, thereby causing shaft 58 to rotate, thereby also causing member 56 to rotate, thereby placing wire feeding unit 28 into its first feeding mode, in which wire feeding unit, by the rotation of first and second sheaves 36, 44, feeds binding wire 30 through guide tube 66. At the same time, the pressing of trigger 94 retracts the forward end 174 of linkage 172 from actuator 154 of four-way valve 144, and actuator 154 remains undisturbed in its extended position, held in place by friction within four-way valve 144, which causes the rod 158 of pneumatic cylinder 138 to remain in its retracted position, thereby keeping member 56 in its first (rearward) position 62.

As best seen in FIGS. 6 and 7, the leading end 110 of wire 30 then is fed through the first opening 68 of first grip piece 70, past rod 126, and into first channel 106 of first finger 96. As the leading end 110 of wire 30 reaches the distal end of first channel 106, it strikes pin 178 at the end of first channel 106 and is directed across gap 104 to the flared distal entrance 124 to second channel 108. Upon entering second channel 108, the leading end 110 of wire 30 proceeds along second channel 108 and then back through first opening 68 of first grip piece 70. After passing through first opening 68 of first grip piece 70, the leading end 110 of wire 30 continues to be fed until it strikes target 156 of actuator 154, thereby causing actuator 154 of four-way valve 144 to retract, thereby causing four-way valve 144 to vent the forward port 146 of pneumatic cylinder 138 and to supply pressurized air to the rearward port 148 of pneumatic cylinder 138, thereby causing rod 158 to extend.

As rod 158 extends, coupling piece 160 is caused to reciprocate forward, which reciprocatingly moves member 56, still turning, out of first (rearward) position 62 and toward second (forward) position 78. As member 56 moves out of its first position 62, first gear 60 of member 56 disengages from second gear 64 of second sheave 44, causing wire feeding unit 28 to enter its second feeding mode, in which it does not feed the wire 30. As coupling piece 160 is caused to reciprocate forward, upper edge 162 of coupling piece 160 engages arm 134, causing arm 134 to pivot upwardly about pivot 135, thereby raising pin 126 within bore 128 of block 130. As coupling piece 160 continues to reciprocate forward, and before member 56 fully reaches its second (forward) position 78, cutter 76 is actuated, and scissor jaws 72, 74 of cutter 76 cut wire 30, leaving a cut portion 22 of wire 30 within first and second channels 106, 108 of first and second fingers 96, 98 and encircling the reinforcing bars 24, 26, with portion 22 of wire 30 having both of its ends passing through the first opening 68 of first grip piece 70 as best seen in FIG. 7.

As coupling piece 160 continues to reciprocate forward, member 56 fully reaches its second (forward) position 78 shown in FIG. 8, and second gripping surface 170 of second grip piece 168 grippingly entraps the ends of the portion 22 of fed binding wire 30 between second gripping surface 170 and first gripping surface 164 of first grip piece 70. Motor 82, still rotating, continues to rotate shaft 58 and member 56 about axis 80, thereby twisting the entrapped ends of portion 22 of wire 30 as seen in FIG. 8. It shall be understood that, as the ends of portion 22 of wire 30 become twisted, the leading end 110 of wire 30 will pull away from target 156 of actuator 154, but actuator 154 will remain in its extended position due to friction within four-way valve 144. Also, as the ends of portion 22 of wire 30 become twisted and tighten about reinforcing bars 24, 26, portion 22 of wire 30 will be drawn around reinforcing bars 24, 26 and out of first and second channels 106, 108 of first and second fingers 96, 98. Eventually, the torque seen by torque-release clutch 84 will reach its pre-adjusted threshold, causing motor 82 to become decoupled from shaft 58, causing the mutual rotation of shaft 58 and member 56 to cease even though trigger 94 may remain depressed, thereby preventing the breaking of wire portion 22.

The operator of apparatus 20 will hear the change in pitch of motor 82 as torque-release clutch 84 disengages, and will then release trigger 94, causing valve 92 to no longer supply pressurized air to motor 82, thereby causing motor 82 to stop spinning When trigger 94 is released, the forward end 174 of linkage 172 will again engage actuator 154 of four-way valve 144 and cause actuator 154 to move to its extended position, thereby causing four-way valve to vent the rearward port 148 of pneumatic cylinder 138 and to supply pressurized air to the forward port 146 of pneumatic cylinder 138, thereby causing pneumatic cylinder 138 to retract rod 158, thereby causing coupling piece 160 to reciprocate rearwardly, thereby allowing spring 133 to pull arm 134 back to its unraised position (shown in solid outline in FIGS. 1 and 11), thereby causing pin 126 to drop and member 56, now no longer rotating because motor 82 has ceased being powered, to move from its second (forward) position 78 back to its first (rearward) position 62. As member 56 moves out of its second (forward) position 78, second grip piece 168 releases the ends of the twisted wire, and the apparatus 20 can be removed from reinforcing bars 24, 26, as they are withdrawn through gap 104.

Figure 12:
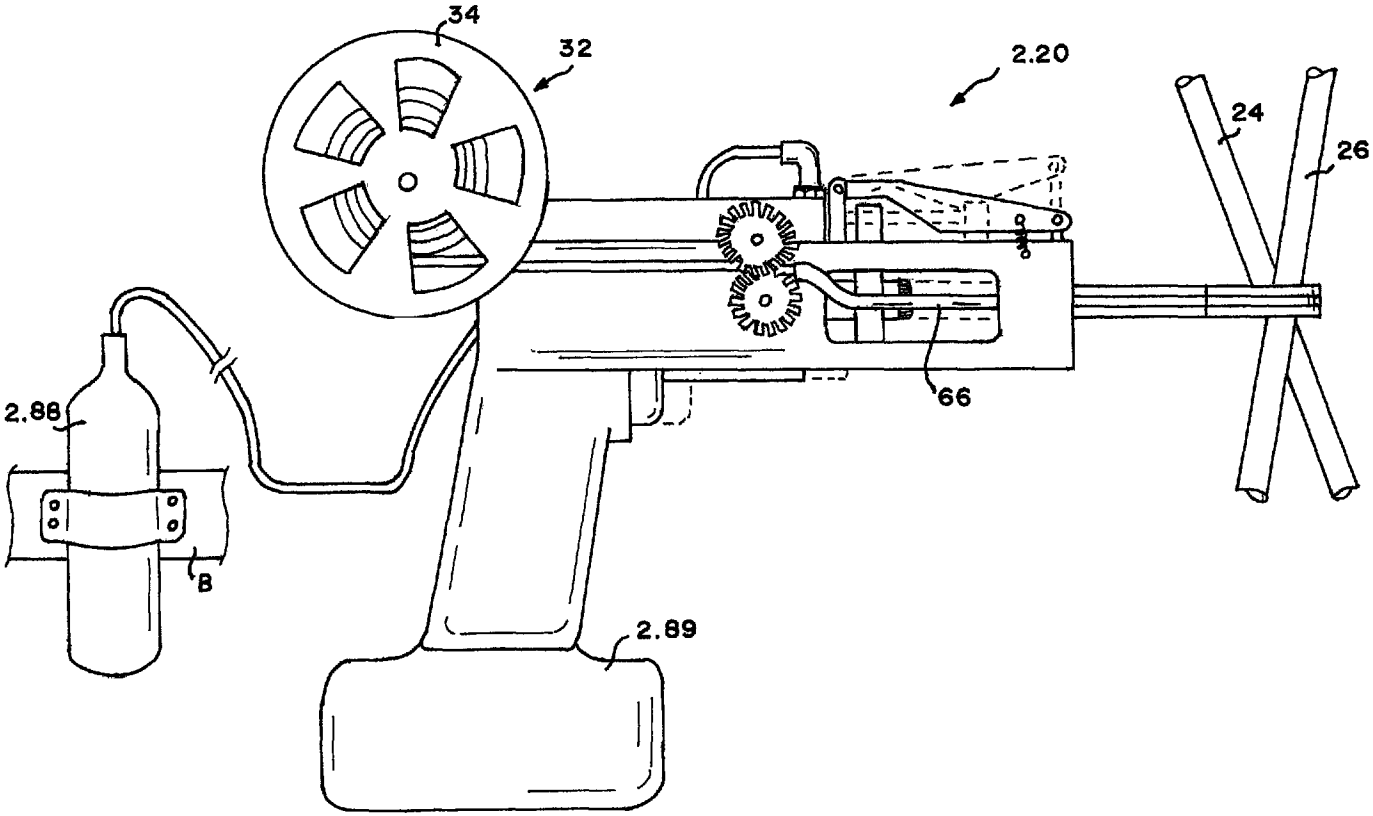
FIG. 12 is a side view of a second embodiment of the present invention, similar to the side view shown in FIG. 1 of the first embodiment.
Figure 13:
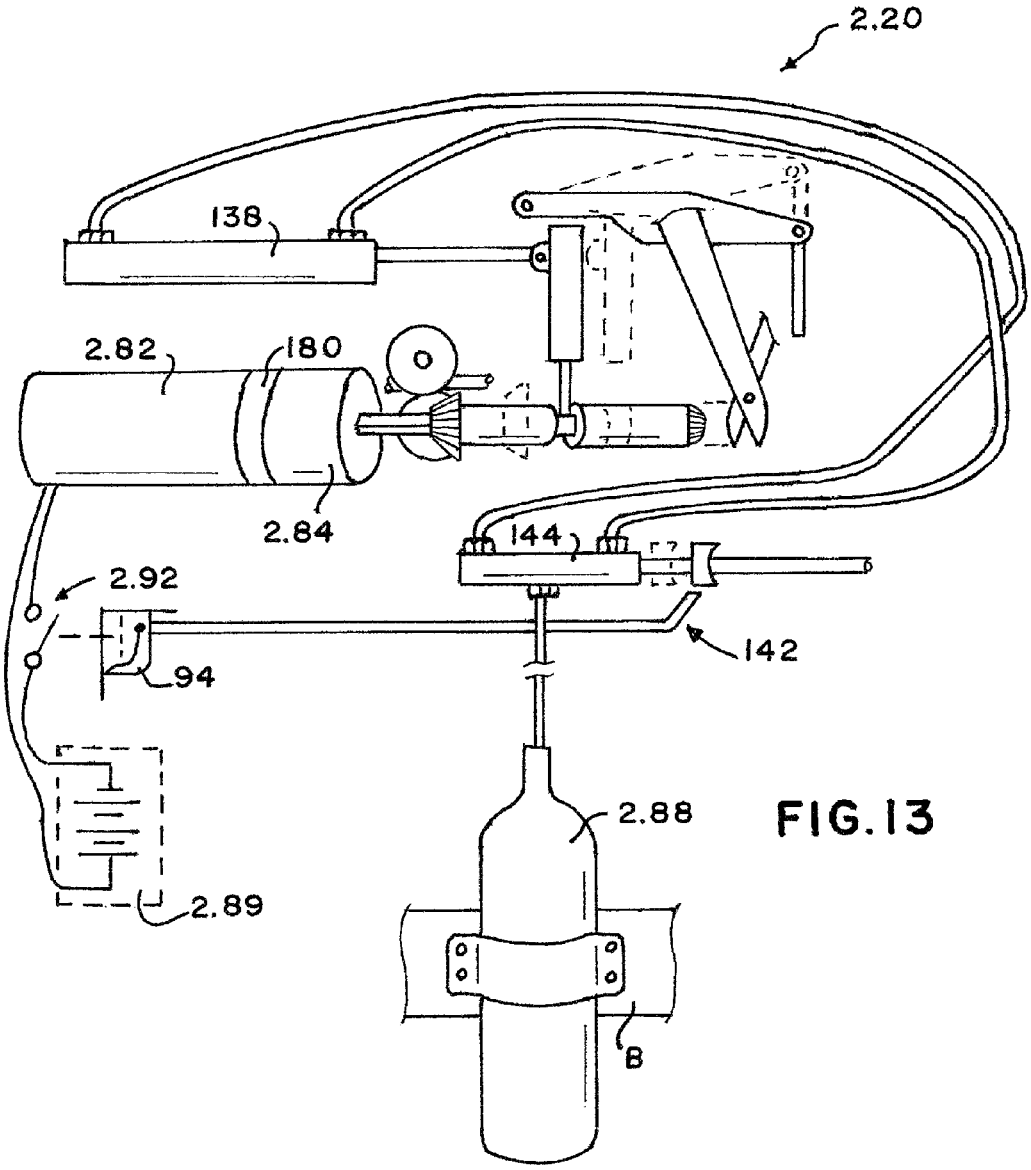
FIG. 13 is a schematic diagram of the second embodiment of the present invention, showing the operation of various parts and similar to the schematic diagram of the first embodiment shown in FIG. 11.

A second preferred embodiment 2.20 of the present invention is shown in FIGS. 12 and 13. FIG. 12 is a side view of the second embodiment, similar to the side view shown in FIG. 1 of the first embodiment. FIG. 13 is a schematic diagram of the second embodiment, showing the operation of various parts and similar to the schematic diagram of the first embodiment shown in FIG. 11. Identifying reference designators for this second embodiment are marked similarly to the first embodiment, except with the prefix "2.". It shall be understood that many aspects of the two embodiments are substantially the same, and only the differences will be treated in detail, it being understood that similar structural features of the two embodiments perform similar functions.

The second embodiment 2.20, rather than having a pneumatic motor 82 as in the first embodiment, instead has an electric motor 2.82 of similar torque and RPM ratings as the pneumatic motor 82 of the first embodiment. Electric motor 2.82, rather than being powered from pressurized air source 88, instead is powered by a well-known rechargeable battery module 2.89. Trigger 94, rather than opening and closing a valve 92 to selectively power the motor 82 by pressurized air as in the first embodiment, instead operates a switch 2.92 to selectively power the electric motor 2.82. Electric motor 2.82 preferably includes a reduction gear drive 180 to reduce the relatively high armature rotational speed of motor 2.82 to a similar RPM as seen with pneumatic motor 82 of the first embodiment, with accompanying increase in output torque, in a manner well-known to those skilled in the art. As with the pneumatic motor 82 of the first embodiment, a torque-release clutch 2.84 is interposed between the output shaft of motor 2.82 and shaft 58, and decouples the output shaft of reduction gear drive 180 from shaft 58 when the torque resistance encountered upon twisting the binding wire increases past a desired threshold, and that torque resistance depends on the size of binding wire being used and how tight of a twisted tie is desired.

Second embodiment 2.20 also has a small bottle of pressurized air 2.88 that is preferably mounted on the worker's belt B so as to operate the four-way valve 144 of control means 142. It shall be understood that the amount of pressurized air required to operate the pneumatic cylinder 138 of the reciprocating means is much smaller than the amount of pressurized air required to operate the motor 82 of the first embodiment, so a relatively small bottle of pressurized air suffices to power the pneumatic cylinder 138. By these differences from the first embodiment, the second embodiment is no longer tethered by a supply hose 90 to a large pressurized air source 88 as is the first embodiment, enabling the second embodiment 2.20 to be used to tie re-bar where such tethering is not possible or practical.

The use and operation of second embodiment 2.20 is the same as for the first embodiment 20, hereinbefore described.

It should be understood that both "long" and "short" versions of first and second opposed fingers 96, 98 are preferably provided with either the first or second embodiments 20, 2.20 of the present invention, with a "long" version being as shown in the drawing figures for use with larger sizes of re-bars 24, 26 and having a larger gap 104 for passage of the larger re-bars therethrough. Likewise, to avoid wasting binding wire when smaller re-bars are being tied, a "short" version of first and second opposed fingers 96, 98 is also preferably provided, having a correspondingly smaller gap 104, for replacement of the "long" version of first and second opposed fingers 96, 98 in those situations when smaller sizes of re-bars are being tied, it being understood that, with smaller re-bars, the encircling fingers 96, 98 can be smaller (and shorter) so as encircle the smaller re-bars without excessive gap between fingers 96, 98. While a larger size of first and second opposed fingers 96, 98 would still work with smaller re-bars, the longer length of channels 106, 108 and longer gap 104 of longer fingers 96, 98 would cause the length of wire portion 22 to be greater than required to tie the smaller re-bars, thereby wasting wire. In normal usage, all of the re-bars on a given job will be of the same size, so changing of the fingers 96, 98 from "long" to "short" versions would not usually be required while working on a given job.

INDUSTRIAL APPLICABILITY

Both embodiments of the present invention provide for binding reinforcing bars together with binding wire so as to stabilize the reinforcing bars during the poring of concrete when building structures of reinforced concrete.

Although the present invention has been described and illustrated with respect to a preferred embodiment and a preferred use therefor, it is not to be so limited since modifications and changes can be made therein which are within the full intended scope of the invention.

I claim:

1. A binding wire twisting apparatus for tying reinforcing bars, said apparatus comprising:

(a) a wire feeding unit for selectively feeding a binding wire, said wire feeding unit having a first feeding mode in which said wire feeding unit feeds said binding wire and a second feeding mode in which said wire feeding unit does not feed said binding wire;

(b) a motor for rotating a shaft of said apparatus, said shaft having a longitudinal axis of rotation;

(c) first and second opposed fingers respectively having first and second distal tips fixedly spaced apart from each other by a gap;

(d) a first grip piece having a first opening therethrough, said first opening being coaxial with said axis of said shaft and having a first gripping surface therearound; said first grip piece being mounted for rotation coaxial with said axis of said shaft; said first and second opposed fingers respectively having first and second opposed channels therein adapted for slidingly receiving said fed binding wire therewithin as a leading end of said fed binding wire is fed through said first opening, into said first channel of said first finger, then across said gap, then into a flared distal entrance of said second channel of said second finger, and then back through said first opening; said first channel having a pin transversely spanning a distal end of said first channel and said pin impacts the direction of said leading end of said fed binding wire into said flared distal entrance;

(e) said shaft having a member coupled for mutual rotation with said shaft and mounted for longitudinal reciprocation with respect to said shaft from a first position to a second position; said member having a second grip piece having a second gripping surface adapted for grippingly entrapping ends of said fed binding wire between said second gripping surface and said first gripping surface with mutual rotation of said first and second grip pieces when said member is in said second position;

(f) reciprocating means, operably coupled to said member, for reciprocating said member from said first position to said second position;

(g) control means for selectively causing said reciprocating means to reciprocate said member from said first position to said second position and back; said control means including a target for being impacted by said leading end of said fed binding wire, thereby causing said control means to reciprocate said member from said first position to said second position;

said first and second opposed channels being in fixed spaced-apart relationship with respect to each other.

2. The apparatus as recited in claim 1, in which said wire feeding unit comprises:

(a) a first sheave having a first circumferential groove therearound; and (b) a second sheave having a second circumferential groove therearound; said second sheave being operably coupled to said first sheave for mutual opposite-direction rotation therewith; said first and second circumferential grooves being adapted for frictionally receiving said binding wire therebetween; one of said first and second sheaves being selectively operably coupled to said member such that, when said member is in said first position, said one of said first and second sheaves is caused to mutually rotate with said member.

3. The apparatus as recited in claim 2, in which said apparatus further comprises a cutter for cutting said fed binding wire as said member reciprocates into said second position.

4. The apparatus as recited in claim 1, in which said apparatus further comprises a cutter for cutting said fed binding wire as said member reciprocates into said second position.

5. The apparatus as recited in claim 1, in which said apparatus further comprises a clutch interposed between said motor and said shaft, said clutch becoming disengaged when said shaft opposes its rotation by said motor by a predetermined torque.

* * * * *